US005598824A

United States Patent [19]

Treusch et al.

[11] Patent Number: 5,598,824

[45] Date of Patent: Feb. 4, 1997

[54] FUEL DELIVERY SYSTEM FOR AN INTERNAL COMBUSTION ENGINE

[75] Inventors: Christopher J. Treusch, St. Clair Shores; James W. Clark, Jr., Ypsilanti; Gerard N. Panasuk, Commerce Township, all of Mich.

[73] Assignee: Ford Motor Company, Dearborn, Mich.

[21] Appl. No.: 632,296

[22] Filed: Apr. 15, 1996

[51] Int. Cl.[6] ..... F02M 37/04

[52] U.S. Cl. ..... 123/470; 123/456; 439/130

[58] Field of Search ..... 123/470, 468, 123/469, 456; 439/130, 76, 77, 82

[56] References Cited

U.S. PATENT DOCUMENTS

| | | | |
|---|---|---|---|
| 4,570,601 | 2/1986 | Ito et al. . | |
| 4,844,036 | 7/1989 | Bassler et al. . | |
| 4,857,003 | 8/1989 | Hafner et al. . | |
| 4,950,171 | 8/1990 | Muzslay | 123/456 |
| 4,991,557 | 2/1991 | DeGrace et al. . | |
| 5,030,116 | 7/1991 | Sakai et al. . | |
| 5,040,512 | 8/1991 | Twilton . | |
| 5,074,269 | 12/1991 | Herbon et al. . | |
| 5,086,743 | 2/1992 | Hickey . | |
| 5,127,382 | 7/1992 | Imoehl | 123/456 |
| 5,129,834 | 7/1992 | Cranford . | |
| 5,168,857 | 12/1992 | Hickey . | |
| 5,178,114 | 1/1993 | McArthur | 123/456 |
| 5,189,782 | 3/1993 | Hickey . | |
| 5,203,304 | 4/1993 | Hafner et al. . | |
| 5,209,204 | 5/1993 | Bodenhausen et al. . | |
| 5,211,149 | 5/1993 | DeGrace, Jr. . | |
| 5,226,391 | 7/1993 | Gras | 123/456 |
| 5,238,415 | 8/1993 | Bittiner | 123/468 |
| 5,295,468 | 3/1994 | Blessing et al. . | |
| 5,299,542 | 4/1994 | Hafner . | |
| 5,350,314 | 9/1994 | Saba . | |
| 5,363,825 | 11/1994 | Becker . | |
| 5,471,961 | 12/1995 | McArthur | 123/456 |
| 5,479,900 | 1/1996 | Bodenhausen | 123/470 |
| 5,501,195 | 3/1996 | Hall | 123/470 |
| 5,513,613 | 5/1996 | Taylor | 123/456 |
| 5,531,202 | 7/1996 | Lorraine . | |

*Primary Examiner*—Carl S. Miller
*Attorney, Agent, or Firm*—Neil P. Ferraro

[57] ABSTRACT

A fuel delivery system for an internal combustion engine having a molded plastic fuel rail with an electrical bus molded therein. The fuel rail has a keying feature which allows orientation of the fuel injector relative to the fuel rail when the fuel injector is inserted into the fuel rail. Further, a locking device is provided to lock the fuel injector to the fuel rail. Male electrical connectors on the fuel rail are formed by exposing a portion of the electrical bus. The fuel delivery system includes an electrical connector assembly for connecting the male connector of the fuel injector to the male connector of the fuel rail. Thus, when the fuel injector is inserted into the fuel rail, mechanical orientation and retention is achieved while at the same time an electrical connection is made.

20 Claims, 4 Drawing Sheets

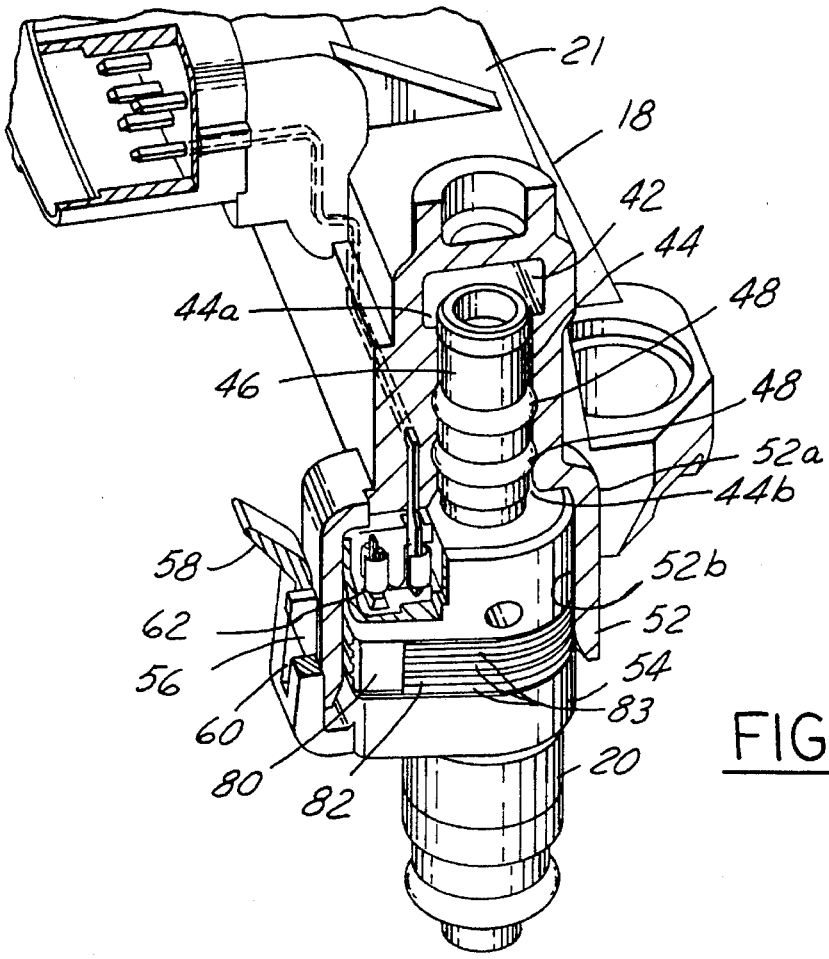
FIG.4
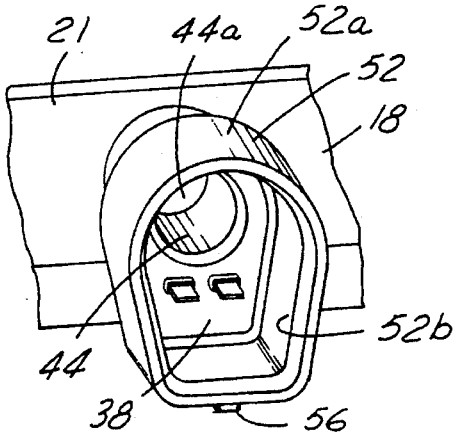
FIG.5
FIG.6
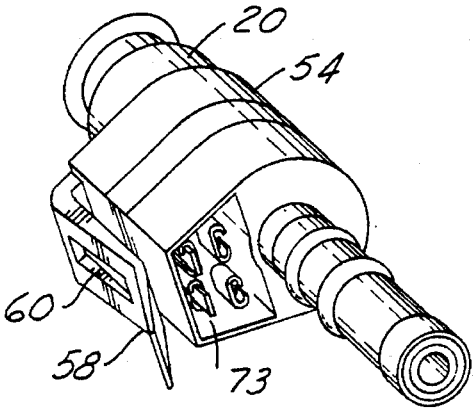

FUEL DELIVERY SYSTEM FOR AN INTERNAL COMBUSTION ENGINE

FIELD OF THE INVENTION

The present invention relates to a fuel delivery system, and more particularly, to a molded plastic fuel rail for supplying fuel and power to a plurality of fuel injectors.

BACKGROUND OF THE INVENTION

During assembly of a fuel delivery system of internal combustion engines having electronically controlled fuel injectors, it is customary to connect the fuel injectors to a fuel rail. Typically, a separate retaining clip retains and orients each fuel injector to the fuel rail. In a further assembly step, the fuel injectors are connected to the engine's control system. To overcome labor intensive assembly procedures, some prior art fuel delivery systems provide retention, orientation and electrical connection of the fuel injector in a single assembly step. To provide electrical power to fuel injectors, some systems utilize wires arranged in a wire guide attached to a standard fuel rail or an electrical bus molded into a plastic fuel rail.

The inventors of the present invention have recognized numerous disadvantages with these prior art systems. For example, prior art systems utilizing an electrical bus molded into the plastic fuel rail typically include a female connector which receives the male connector of the fuel injector. This presents significant molding issues because the two halves of the mold generally join at the location where the connectors are formed. Thus, the mold might crush the female connector, rendering the fuel rail useless. Systems utilizing a male connector in the fuel rail typically require a connector having a female portion at both ends to connect to the male connector on the fuel rail and the male connector on the fuel injector. These female connectors require that the two male connectors be collinear in a butting, non-overlapping relationship, which undesirably increases the overall length of the fuel rail/fuel injector electrical connector assembly.

Further, some prior art systems utilize a pressure regulator mounted to a plastic fuel rail to maintain the proper fuel pressure in the fuel rail. It is well known that a static charge may occur on the body of the pressure regulator. To drain off this static charge, prior art systems coat the plastic fuel rail with a metallic paint so that a ground path exists between the pressure regulator and the engine. A disadvantage of this approach is increased material and labor costs.

SUMMARY OF THE INVENTION

An object of the present invention is to provide a plastic molded fuel rail for simultaneously retaining, orienting and electrically connecting a fuel injector to the fuel rail.

This object is achieved and disadvantages of prior art approaches overcome, by providing a novel elongate molded plastic fuel rail for delivering fuel to a plurality of fuel injectors of an internal combustion engine. The fuel rail includes a body having a fluid conduit molded therein and a plurality of fuel injector receiving portions spaced along the length of the body. An electrical bus having a plurality of electrical leads is integrally molded into the body of the fuel rail. The leads have first and second ends that are exposed for connection to an electronic engine controller and for connection to a male connector on a fuel injector, respectively. Thus, the injector is controlled by signals received from the engine controller. Each exposed end of the electrical bus is formed with a male connector. An electrical connector assembly is used for connecting the male connector formed on the body of the fuel rail to the male connector of the fuel injector. The assembly includes a U-shaped female connector having a female connector on each leg thereof positioned such that one leg of the female connector engages the male connector of the fuel injector and the other leg of the female connector engages the male connector formed on the body of the fuel rail.

An advantage of the present invention is that fuel injectors may be easily mounted to a fuel rail such that both mechanical retention and orientation, as well as electrical connection, may be accomplished during a single assembly step.

Another advantage of the present invention is that an easily manufacturable and low cost fuel rail is provided.

Still another advantage of the present invention is that a less complex fuel delivery system having a reduced number of mechanical and electrical components is provided.

Yet another advantage of the present invention is that the overall length of the fuel rail/fuel injector connector assembly is reduced.

Other objects, features and advantages of the present invention will be readily appreciated by the reader of this specification.

BRIEF DESCRIPTION OF THE DRAWINGS

The invention will now be described, by way of example, with reference to the accompanying drawings, in which:

FIG. 4 is a partial cross-sectional view showing a fuel injector mounted in a fuel rail according to the present invention;

FIG. 5 is perspective view of a portion of a fuel rail according to the present invention;

FIG. 6 is a perspective view of a fuel injector according to the present invention;

DETAILED DESCRIPTION OF THE PREFERRED EMBODIMENTS

Figure 1:
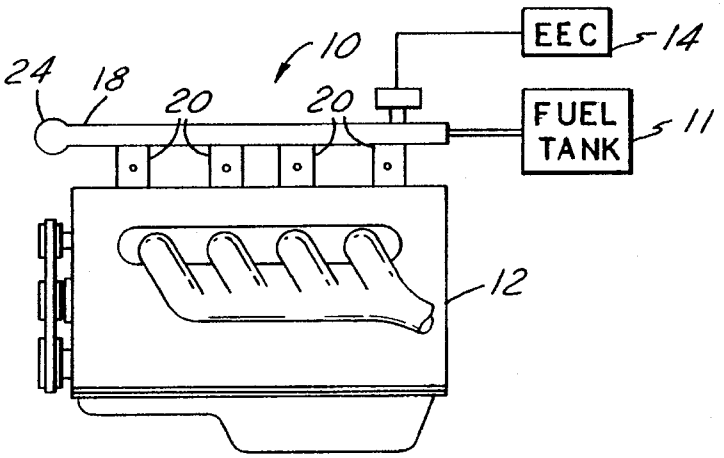
FIG. 1 is a diagrammatic view of a fuel delivery system of an internal combustion engine.
Figure 2:
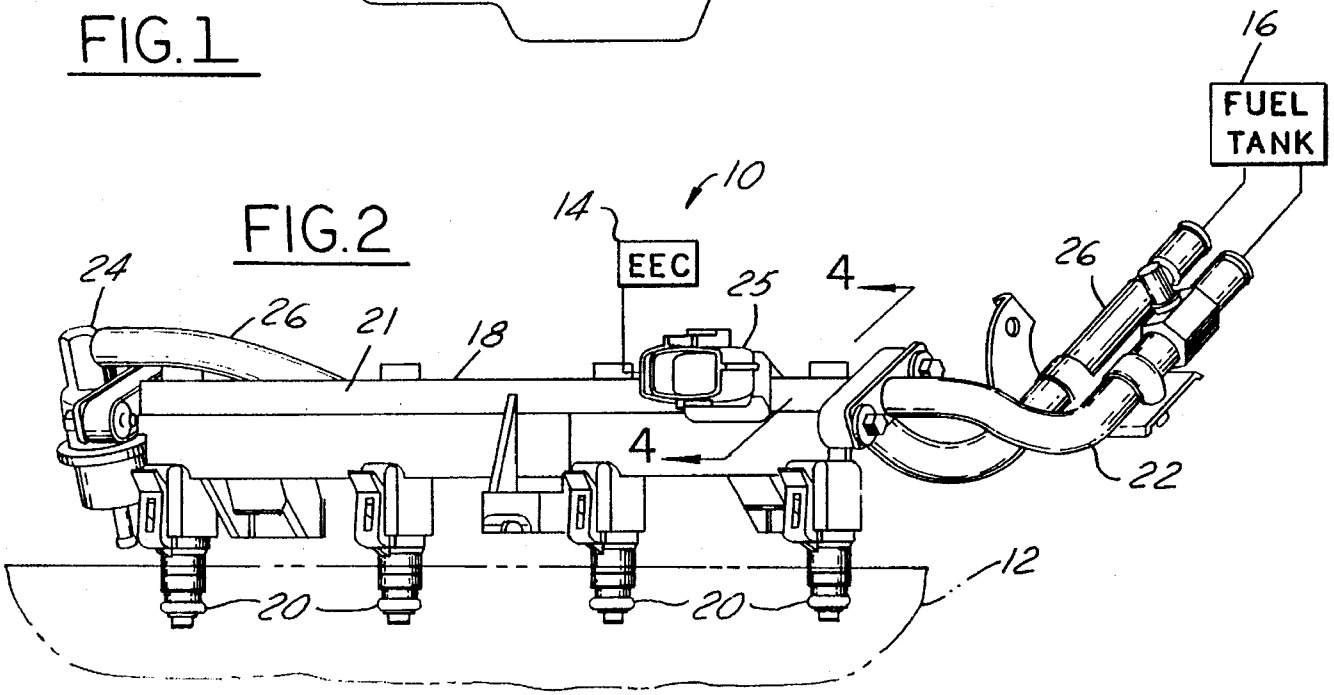
FIG. 2 is a diagrammatic perspective view of the fuel delivery system.

Fuel delivery system 10, shown in FIGS. 1 and 2, supplies fuel from fuel tank 11 to internal combustion engine 12 upon actuation by electronic engine controller 14. Fuel delivery system 10 includes elongate molded plastic fuel rail 18 connected to a plurality of top feed fuel injectors 20 spaced along the length of fuel rail body 21. Fuel supply line 22 delivers fuel from fuel tank 11 to fuel rail 18. Pressure regulator 24 is mounted to fuel rail 18 to control the pressure therein. Controller 14 is electrically connected to fuel rail 18 through fuel rail connector 25, and to fuel injectors 20 as will be further described hereinafter. As is well known to those skilled in the art, fuel injectors 20 are intermittently actuated by controller 14 to provide the required amount of fuel to engine 12. Excess fuel in fuel rail 18 is returned to tank 11 through return line 26. Although fuel delivery system 10 is shown in this example to be a return-type fuel system, those skilled in the art will recognize in view of this disclosure that fuel delivery system 10 may be used in a returnless fuel system as well.

Figure 3A:
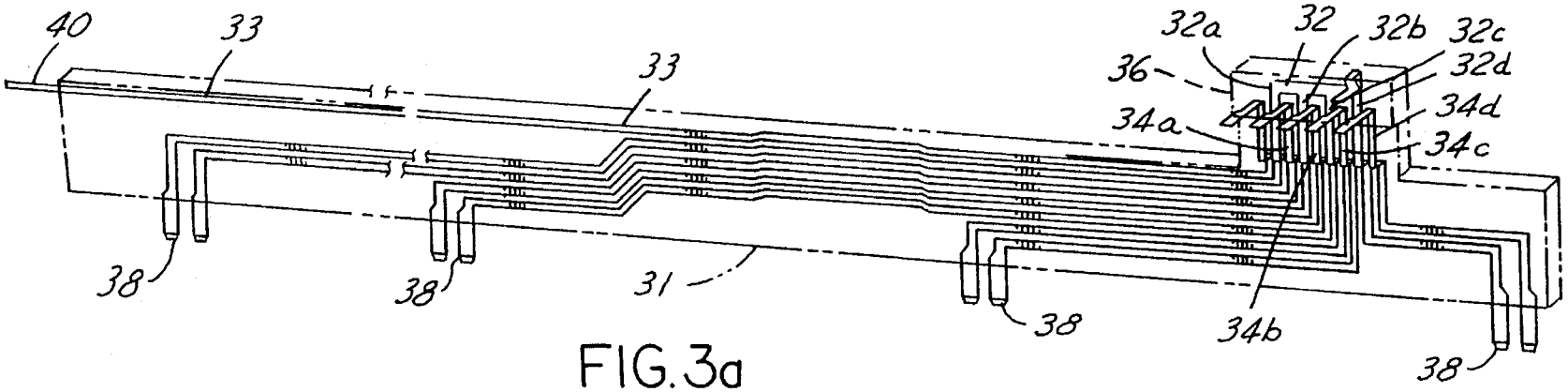
FIGS. 3*a* and 3*b* are diagrammatic perspective views of an electrical bus for a fuel rail of the fuel delivery system.

As shown in FIG. 3*a*, body 21 of molded plastic fuel rail 18 contains electrical bus 29 having a plurality of electrical leads molded therein. Electrical bus 29 is molded first in preform 31, shown in phantom. Preform 31 is then molded into body 21 of fuel rail 18, shown in phantom in FIG. 3*b*. Bus 29 provides the equivalent of power distribution lead 32 having 4 conjoined leads 32*a* 32*d*, ground lead 33 and four power return leads 34*a*–34*d*. According to the present invention, power distribution leads 32*a*–32*d* and power return leads 34*a*–34*d* are located in the same plane such that connection to fuel injector 20 may be made on one side of fuel rail 18. To accomplish this, power distribution leads 32*a*–32*d* are positioned adjacent to their respective power return leads 34*a*–34*d* in the same plane. This alternating pattern has the added benefit of minimizing electromagnetic interference (EMI) within fuel rail 18.

Each electrical lead has a first end 36 for connection to the electrical system of engine 12, which includes electronic engine controller 14. Second ends 38 and 40 provide connection to fuel injectors 20 and pressure regulator 24, respectively. During the molding of fuel rail 18, ends 36 and 38 are exposed, thereby forming male connectors. Thus, according to the present invention, the mold used to form fuel rail 18 positively seals against ends 36, 38 and 40 thereby preventing any leakage of molten plastic during molding while maintaining the integrity of the resulting male connector. If, on the other hand, ends 36, 38 and 40 were formed with female connectors, a more difficult and expensive molding operation would be required to maintain the integrity of the female connector.

Because a build up of static charge may occur on the body of pressure regulator 24, a ground connection is made to the electrical bus 29 at end 40 of ground lead 33, thereby obviating the need for metallic paint on body 21 of fuel rail 18. Thus, pressure regulator 24 may be properly grounded to the electrical system of engine 12 when pressure regulator 24 is assembled to fuel rail 18.

Assembly of fuel injector 20 into fuel rail 18 will now be described with reference to FIGS. 4–6. In FIG. 4, fuel injector 20 is shown inserted into fuel rail 18. Fuel rail 18 has fuel supply conduit 42 extending along the length of body 21 for supplying fuel to fuel injectors 20. Cylindrical port 44 has proximal 44*a* and distal 44*b* ends (see also FIG. 5). Port 44, which is substantially perpendicular to and in fluid communication with conduit 42, receives cylindrical inlet tube 46 of injector 20 to supply fuel thereto. O-rings 48 provide a seal to prevent fuel from leaking past fuel injector 20.

Conduit 42 has a substantially rectangular cross section to aid in molding fuel rail 18. During molding of fuel rail 18, a rectangular core (not shown) is inserted into the mold and occupies the space that will later define conduit 42. Similarly, a core (not shown) is inserted into the mold and occupies the space that will later define port 44. Thus, the core occupying port 44 has a flat top which butts against the bottom surface of the core occupying conduit 42. If the core that defines conduit 42 were cylindrical, then the core used to form port 44 would require a concave top to conform to that shape, thereby dictating a more complex and expensive molding procedure.

Fuel rail 18 has pocket 52 having exterior wall 52*a* and interior wall 52*b* to define pocket space 53 for receiving body 54 of fuel injector 20. Pocket 52 is shaped to provide a keying or anti-rotation feature such that fuel injector 20 may be axially oriented relative to fuel rail 18, which may be necessary for targeting the fuel in a multi-port engine. In a preferred embodiment, pocket 52 and body 54 are D-shaped to provide the keying feature. Of course, any shape other than circular may be used to prevent rotation.

Locking tab 56 is provided on exterior wall 52*a* of pocket 52 to retain fuel injector 20 in pocket 52. Locking tongue 58 is cantilevered on body 54 of fuel injector 20 and has opening 60 to engage locking tab 56. Thus, during insertion of fuel injector 20 into fuel rail 18, tongue 58 is wedged open by tab 56 until opening 60 becomes aligned with tab 56. Of course, locking tongue 58 may be formed on fuel rail 18 and locking tab 56 may be formed on fuel injector 20.

Electrical connection between fuel injector 20 and electric bus 29 of fuel rail 18 is made through fuel rail/fuel injector connector assembly 62 (FIG. 4) as will be further described hereinafter. Thus, according to the present invention, mechanical retention and orientation as well as electrical connection may be made between fuel injector 20 and fuel rail 18 in a single insertion assembly step.

Figure 3B:
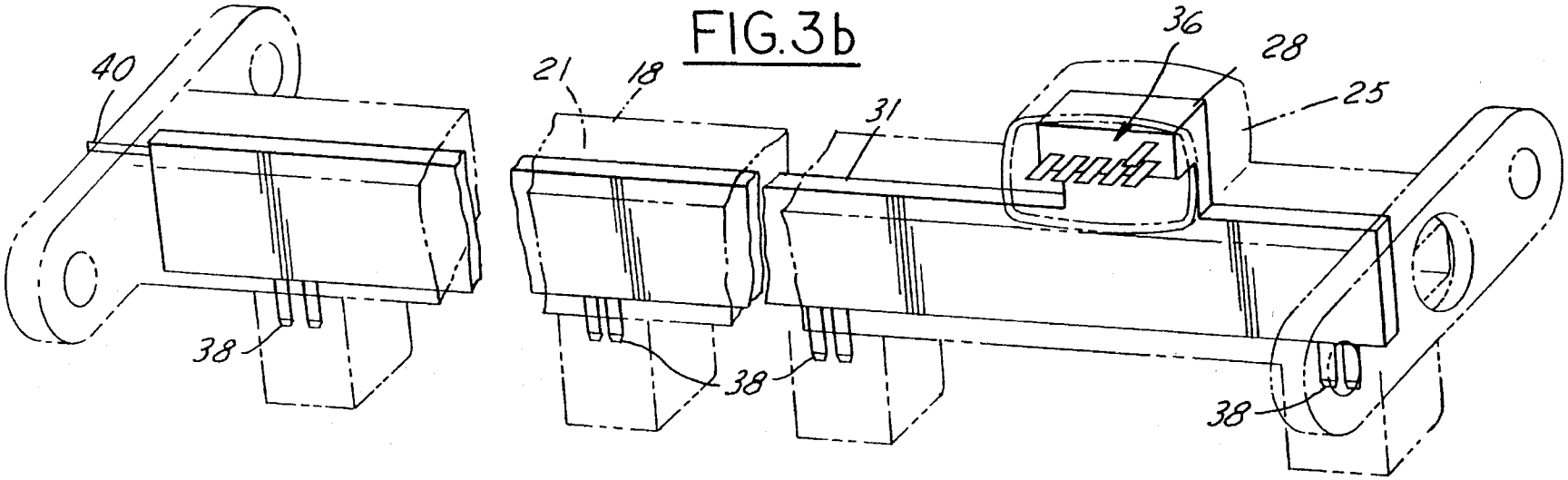
Figure 7A:
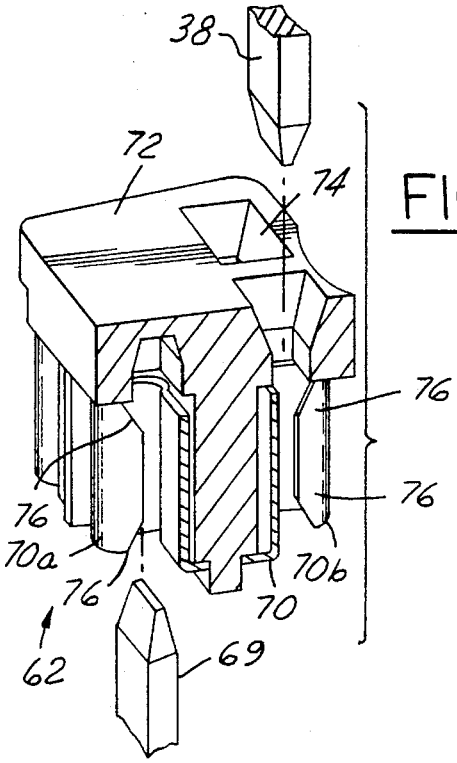
FIG. 7*a* and 7*b* are exploded perspective views of an electrical connector assembly according to the present invention; and, FIG. 8 is an alternative embodiment of the present invention.
Figure 7B:
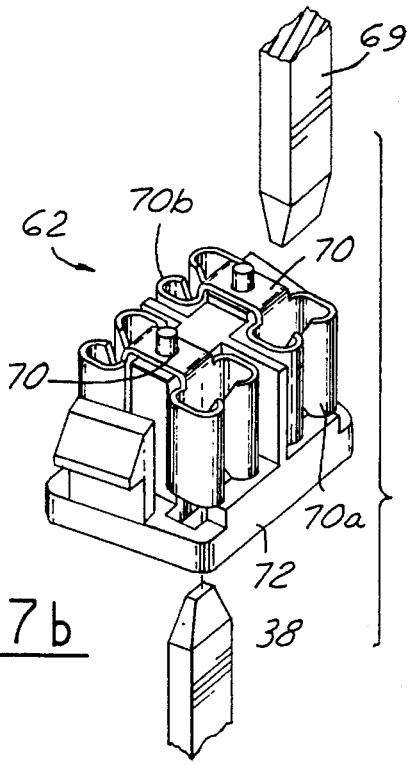

For similar reasons as described with reference to FIGS. 3*a* and 3*b*, fuel injector 20 is also molded with male connectors 69. However, to engage male connector 38 of fuel rail 18, U-shaped female connector 70 having a female connector on each leg 70*a* and 70*b*, shown in FIGS. 7*a* and 7*b*, is provided. In particular, referring to FIG. 7*a*, U-shaped female connector 70 is attached to retainer 72. Cavity 73 in fuel injector 20, shown in FIG. 6, receives retainer 72. For clarity, in FIG. 6, retainer 72 is not shown.

Continuing with FIG. 7*a*, retainer 72 includes chamfered portion 74 for guiding male connector 38 of fuel rail 18 therein. In addition, each leg 70*a* and 70*b* of U-shaped female connector 70 have chamfered ends 76 for ease of insertion of connectors 38 and 69 from either direction. FIG. 7*b*, which is an underside view of retainer 72 of FIG. 7*a*, shows two U-shaped female connectors 70 attached to retainer 72. Thus, for example, positive male connector 69 of fuel injector 20 engages leg 70*a* of U-shaped female connector 70 while positive male connector 38 of fuel rail 18 engages leg 70*b* of U-shaped female connector 70. The other U-shaped female connector 70 is connected to the negative male connectors of fuel injector 20 and fuel rail 18, respectively. Because male connectors 38 and 69 are not collinear but nevertheless overlap each other, according to the present invention, by using U-shaped female connector 70, the overall axial length of fuel rail/fuel injector connector assembly 62 is reduced when compared to a connector assembly where the two male connectors are in a non-overlapping collinear relationship.

Figure 8:
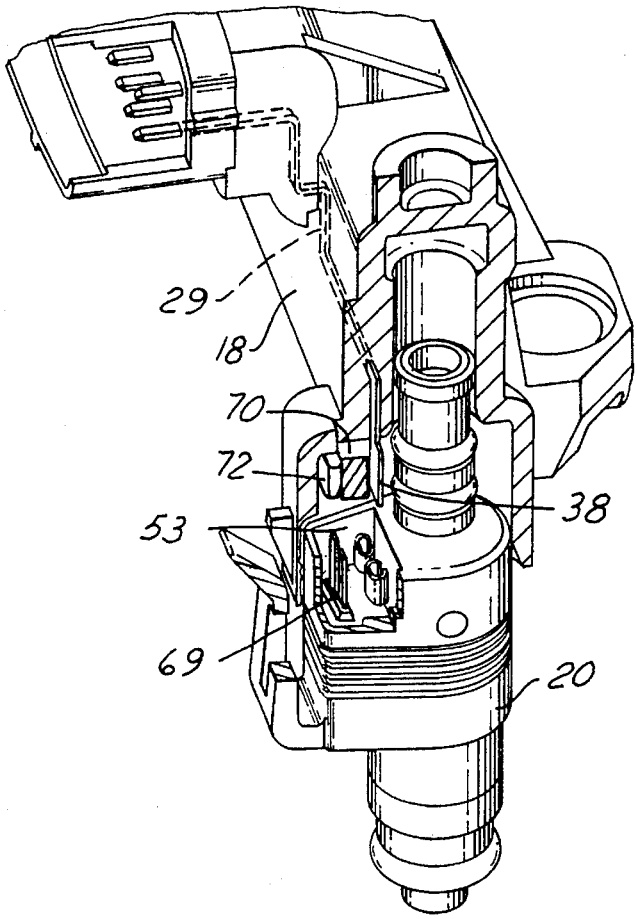

Those skilled in the art will recognize in view of this disclosure that retainer 72 having U-shaped female connectors 70 may be attached to fuel rail 18 rather than housed in a cavity in fuel injector 20 as described above. Thus, as shown in FIG. 8, U-shaped female connector 70 is positioned in pocket space 53 of fuel rail 18 to connect to male connectors 38 and 69 of bus 29 and fuel injector 20, respectively, to form connector assembly 62 when fuel injector 20 is assembled to fuel rail 18. For clarity, fuel injector 20 is disengaged from fuel rail 18 in FIG. 8.

In a preferred embodiment, body 54 of fuel injector 20 is formed with groove 80 (FIG. 4), located about its periphery, to receive connector seal 82 (shown partially broken). Thus, seal 82 seals the interface between body 54 and interior wall 52*b* to reduce contamination of fuel rail/fuel injector connector assembly 62. In a preferred embodiment, connector seal 82 is provided with a plurality of axially spaced portions 83, each having a rectangular cross-section, conjoined together.

While the best mode for carrying out the invention has been described in detail, those skilled in the art in which this invention relates will recognize various alternative designs and embodiments, including those mentioned above, in practicing the invention that has been defined by the following claims.

We claim:

1. An elongate molded plastic fuel rail for delivering fuel and power to a plurality of fuel injectors of an internal combustion engine, the engine having an engine controller, with said fuel rail comprising:

a body having a fluid conduit molded therein;

a plurality of fuel injector receiving portions spaced along the length of said body;

an electrical bus having a plurality of electrical leads integrally molded into said body of said fuel rail, with said leads having first and second ends, said first end being exposed for connection to an electronic controller of the engine and said second end being exposed for connection to a male connector on the fuel injector so that the injector may be controlled by signals received from the engine controller, with each said exposed end of said electrical bus comprising male connectors; and, an electrical connector assembly for connecting said male connector formed on said body of said fuel rail to the male connector of the fuel injector, with said assembly comprising a U-shaped female connector having a female connector on each leg thereof positioned such that one leg of said female connector engages the male connector of the fuel injector and the other leg of said female connector engages said male connector formed on said body of said fuel rail.

2. A fuel rail according to claim 1 wherein each said fuel injector receiving portions further comprises an anti-rotation means cooperating with the fuel injector for restricting rotation between said body of said fuel rail and the fuel injector.

3. A fuel rail according to claim 1 wherein each said receiving portion further comprises a locking means cooperating with the fuel injector for removably locking the fuel injector to said body of said fuel rail.

4. A fuel rail according to claim 1 further comprising an electrical connector connected to said electrical bus for receiving electrical signals from the engine controller.

5. A fuel rail according to claim 1 wherein adjacent leads of said electrical bus have opposite polarity when said fuel rail is electrically connected to said engine controller.

6. A fuel rail according to claim 1 wherein said conduit has a substantially rectangular cross-section.

7. A fuel rail according to claim 1 wherein said electrical bus is pre-molded into a plastic preform.

8. A fuel delivery system for an internal combustion engine having an electronic engine controller, said system comprising:

a molded plastic fuel rail for supplying fuel and power to a plurality of fuel injectors of said engine, with said fuel rail comprising:

a body having a fluid conduit molded therein;

a plurality of fuel injector receiving portions spaced along the length of said body, with each said receiving portion comprising:

a port having a proximal and a distal end, with said port being in fluid communication with said conduit at said proximal end; and, a pocket formed on said body of said fuel rail at said distal end of said port, with said pocket having an exterior and an interior wall thereby defining an interior pocket space;

an electrical bus having a plurality of electrical leads integrally molded into said body of said fuel rail, with said leads having first and second ends, said electrical bus having a male fuel rail connector formed on said body of said fuel rail for connection to said electronic engine controller and a male fuel injector connector formed on said body of said fuel rail within said pocket space adjacent said port, with each said connector comprising exposed first and second ends, respectively, of said plurality of electrical leads;

a plurality of fuel injectors having a male electrical connector, said injectors being inserted into said pocket for communication within said port; and, an electrical connector assembly for connecting said male connector formed on said body of said fuel rail to said male connector of the fuel injector, with said assembly comprising a U-shaped female connector having a female connector on each leg thereof positioned such that one leg of said female connector engages the male connector of the fuel injector and the other leg of said female connector engages said male connector formed on said body of said fuel rail.

9. A fuel delivery system according to claim 8 wherein said U-shaped electrical connector is located in said fuel injector.

10. A fuel delivery system according to claim 8 wherein said U-shaped electrical connector is located in said pocket.

11. A fuel delivery system according to claim 8 wherein each said fuel injector receiving portion further comprises an anti-rotation means cooperating with said fuel injector for restricting rotation between said body of said fuel rail and said fuel injector.

12. A fuel delivery system according to claim 8 wherein each said receiving portion further comprises a locking means cooperating with the fuel injector for removably locking the fuel injector to said body of said fuel rail.

13. A fuel delivery system according to claim 8 further comprising an electrical connector connected to said electrical bus for receiving electrical signals from the engine controller.

14. A fuel delivery system according to claim 8 wherein said electrical bus further comprises a male regulator connector formed on said body of said fuel rail and wherein said fuel delivery system further comprises a pressure regulator mounted to said fuel rail and being in fluid communication with said conduit for regulating fuel pressure therein, with said pressure regulator being connected to said male regulator connector.

15. A fuel delivery system according to claim 8 wherein said electrical bus is pre-molded into a plastic preform.

16. A fuel delivery system according to claim 8 wherein adjacent leads of said electrical bus have opposite polarity when said fuel rail is electrically connected to said engine controller.

17. A fuel delivery system according to claim 11 wherein said anti-rotation means comprises a D-shaped pocket on said body of said fuel rail and a D-shaped body on said fuel injector.

18. A fuel delivery system according to claim 8 wherein said conduit has a substantially rectangular cross-section.

19. A fuel delivery system for an internal combustion engine, said engine having an electronic engine controller, with said system comprising:

an elongate molded plastic fuel rail mounted to said engine comprising:

a body having a fuel supply conduit molded into and extending along the length thereof, with said conduit defining a longitudinal axis and having a substantially rectangular cross-section;

a plurality of fuel injector connection portions each comprising a cylindrical port defining an axis and having a proximal and a distal end, with said port being in fluid communication with said conduit at said proximal end and with said port axis being substantially perpendicular to said conduit axis, and with a D-shaped pocket formed on said body of said fuel rail at said distal end of said cylindrical port, with said D-shaped pocket having an exterior and an interior wall thereby defining an interior pocket space;

an electrical bus having a plurality of electrical leads integrally molded into said body of said fuel rail, with said leads having first and second ends, said electrical bus having a male fuel rail connector formed on said body of said fuel rail for connection to said electronic engine controller and a male fuel injector connector formed on said body of said fuel rail within said pocket space of said D-shaped pocket adjacent said cylindrical port, with each said connector being formed by exposing said ends of said plurality of electrical leads;

a plurality of top feed fuel injectors removably mounted to said fuel rail for delivering fuel from said fuel rail conduit to said engine, with each said fuel injector comprising a cylindrical inlet tube defining an axis, said inlet tube having a free end being sealingly inserted into one of said cylindrical ports of said fuel rail such that said inlet tube is in fluid communication with said fuel supply conduit, and a D-shaped body located at an end of said inlet tube opposite said free end, said D-shaped body engaging within said interior space of said D-shaped pocket and cooperating therewith to provide an anti-rotation means for preventing rotation of said injector relative to said fuel rail, with said engagement thereby forming an interface;

an electrical connector assembly for connecting said male connector formed on said body of said fuel rail to said male connector of said fuel injector, with said assembly comprising a U-shaped female connector having a female connector on each leg thereof positioned in said fuel injector such that one leg of said female connector engages the male connector of the fuel injector and the other leg of said female connector engages said male connector formed on said body of said fuel rail;

a connector seal sealingly engaging said interface between said D-shaped body of said fuel injector and said D-shaped pocket so as to seal said connector assembly; and, a locking means for removably locking said fuel injector to said fuel rail.

20. A fuel delivery system according to claim 18 wherein adjacent leads of said electrical bus have opposite polarity when said fuel rail is electrically connected to said engine controller.

* * * * *